US005783018A

United States Patent [19]

Gore et al.

[11] Patent Number: 5,783,018

[45] Date of Patent: Jul. 21, 1998

[54] APPARATUS FOR CLEANING LABELS AND METHOD THEREFOR

[75] Inventors: Kiron Gore, Libertyville; Steven Lustig, Wheeling, both of Ill.

[73] Assignee: Motorola, Inc., Schaumburg, Ill.

[21] Appl. No.: 628,306

[22] Filed: Apr. 5, 1996

[51] Int. Cl.[6] ..... B08B 1/04

[52] U.S. Cl. ..... 156/281; 15/104.002; 156/238; 156/277; 156/389

[58] Field of Search ..... 156/281, 238, 156/277, 389; 15/104.002

[56] References Cited

U.S. PATENT DOCUMENTS 3,872,961 3/1975 St. James ..... 400/702
4,034,843 7/1977 Newman et al. ..... 400/240.1
4,257,079 3/1981 Yoshizawa ..... 360/137
4,982,469 1/1991 Nishiwaki ..... 15/104.002 X
5,470,420 11/1995 Yokajty ..... 156/566

*Primary Examiner*—Francis J. Lorin
*Attorney, Agent, or Firm*—Felipe J. Farley; Kelly A. Gardner; Scott M. Garrett

[57] ABSTRACT

Labels (12) are disposed on a carrier strip (10), which is routed from a feed reel (22), over a guide (24), idlers (26 & 28), through a printer (30), over a peeler plate (32), and to a pick-up reel (34). The labels are cleaned of dust prior to printing by effectively rolling an adherent surface (36) over the printing surface (14) of each label as it moves past the guide.

5 Claims, 3 Drawing Sheets

APPARATUS FOR CLEANING LABELS AND METHOD THEREFOR

TECHNICAL FIELD

This invention relates in general to automated labeling equipment, and more particularly to automated labeling equipment which prints information on labels.

BACKGROUND

Labels are used in a wide variety of applications to affix information to an article to be labeled. There are likewise a great number of methods for providing labels and applying labels to articles. One such method involves providing a label with a print surface, and then printing information on the label after the article has been assembled. The information printed on the label may include information about the time the article was assembled, lot numbers, date codes, etc. Other information may be pre-printed on the label, such as a manufacturers logo, for example.

Labels of this sort are typically supplied on a reeled carrier strip, and the carrier strip is routed through the label dispensing equipment appropriately. As the articles are assembled, labels are printed with specific information. This method of preparing labels is used in numerous fields, such as, for example, pharmaceuticals, food products, and others where the date of production is important.

In preparing the labels, the printing surface of the label must be cleaned of dust and other particulate matter, otherwise the printing medium may be rubbed off easily since it is disposed over the dust, and not on the printing surface. The dust is typically comprised of paper fibers and other by products of making the carrier strip, and are held to the labels by static electricity. Some methods have been devised to remove the dust from the labels prior to printing. These include the use of jetted airstreams and brushes. Jetted airstreams are used in an attempt to blow the dust off of the labels. This method works best with larger particles, but smaller particles typically remain. The use of brushes typically works well, but care must be taken to avoid dust build-up, since the dust can break free of the brush and end up on the labels. This is not always predictable; different climates create different levels of static charge on the labels, and the amount of dust present may vary. Accordingly, brushes require careful observation to ensure that dust build-up does not occur. In automated equipment, such observation can be expensive. Therefore there exists a need in labeling apparatus for a means by which dust can be removed from the printing surface of the labels, without the need for such careful observation.

DETAILED DESCRIPTION OF THE PREFERRED EMBODIMENT

Figure 1:
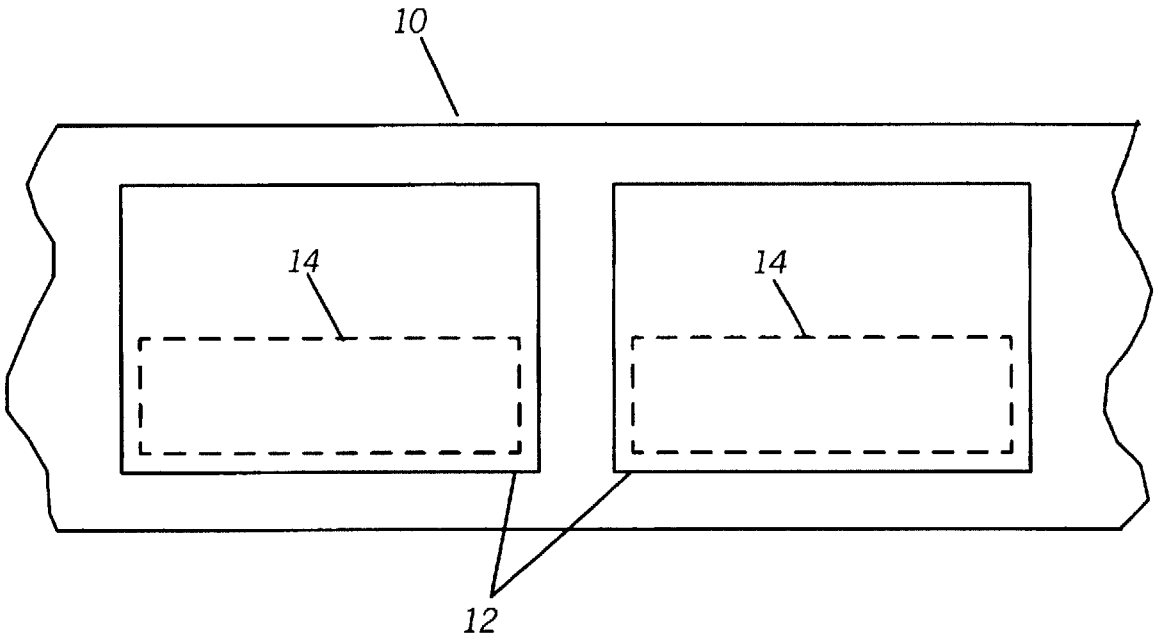
FIG. 1 is an illustration of a portion of a carrier strip and labels for use with the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is illustrated therein a carrier strip 10 and labels 12 for use with the invention. At least a portion of the label is used as a printing surface 14. The labels are adhesively backed, and the carrier strip is covered with a release layer. The labels adhere to the carrier strip with a low tack force so that they can be easily removed with sufficient force. The carrier strip is typically made from a wide roll of carrier strip material which is slit at the appropriate width. This slitting operation is responsible for most of the dust particles.

Figure 2:
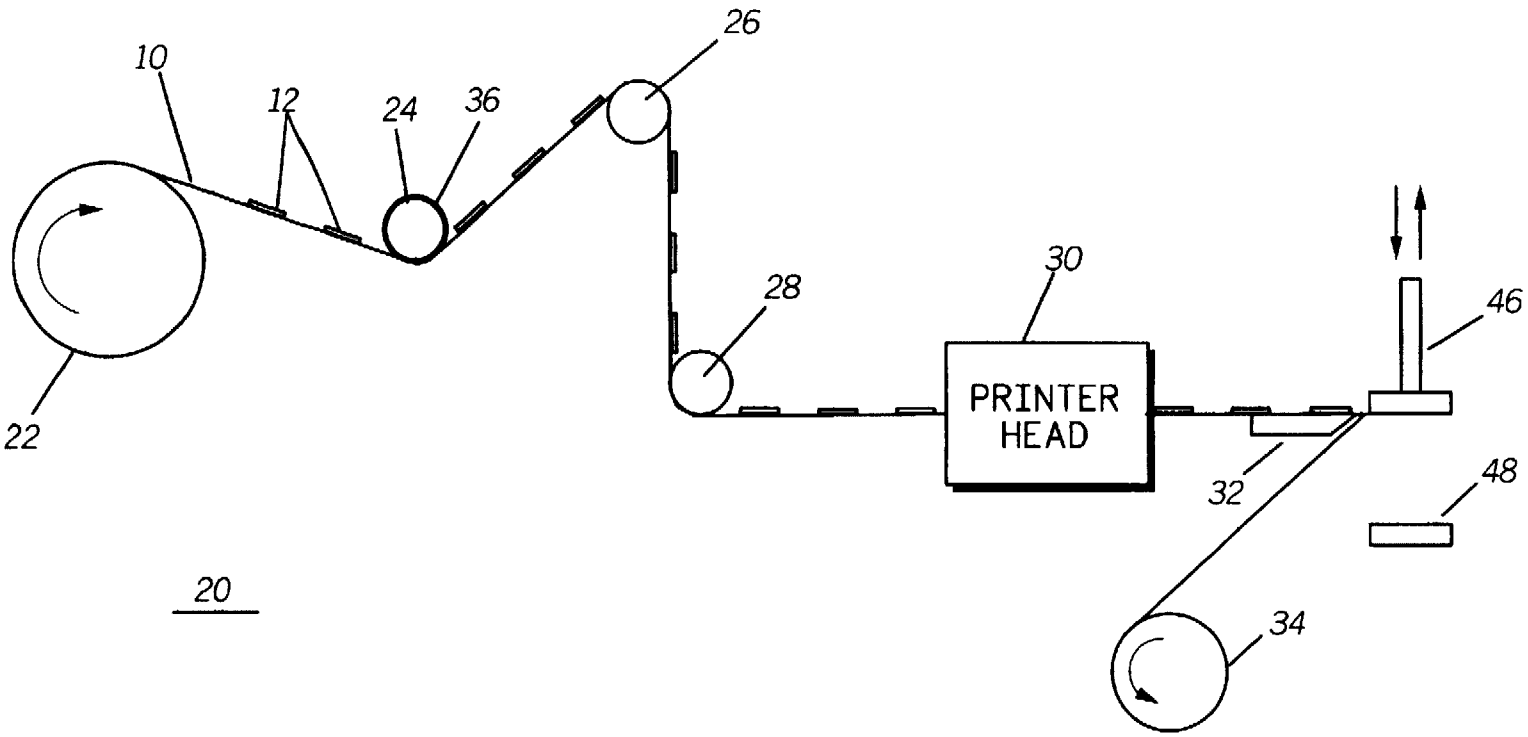
FIG. 2 is a diagram of a labeling apparatus in accordance with a first embodiment of the invention.

Referring now to FIG. 2, there is illustrated therein a diagram of a labeling apparatus 20 in accordance with a first embodiment of the invention. The carrier strip 10 with labels 12 is wound onto a feed reel 22, which feeds the carrier strip to the apparatus by routing it from the feed reel over a guide 24, a first idler roller 26, a second idler roller 28, through a printer 30, over a peeler plate 32, and onto a pick-up reel 34. The carrier strip, in conjunction with the feed reel and pick-up reel constitute a means for moving the labels, and the pick-up reel is driven by a motor, such as a stepping motor to move the carrier strip through the apparatus. The guide 24 deflects the carrier strip such that a force is exerted onto the guide, and the labels are moved past the guide. The guide has a guide surface, an adherent surface 36 is disposed between the carrier strip and the guide surface, and contacts each label at a contact area 38. As the labels move past the guide, the adherent surface moves with the labels such that the adherent surface is effectively rolled across the print surface of the labels. The dust on the labels is then substantially transferred from the printing surfaces of the labels to the adherent surface. The adherent surface must provide enough tack to substantially remove the dust, but not so much that it overcomes the tack force of the label adhesive on the carrier strip, otherwise the adherent surface will remove the labels from the carrier strip.

In the first embodiment, the guide 24 is a roller having a roller surface, and the adherent surface is attached to the roller surface. The roller is preferably a free rolling type, and rotation is imparted by the carrier strip as it moves past the roller. The adherent surface can be fabricated of, for example, a low tack tape disposed on the roller surface, or a soft rubber member coaxially located over the roller.

Figure 3:
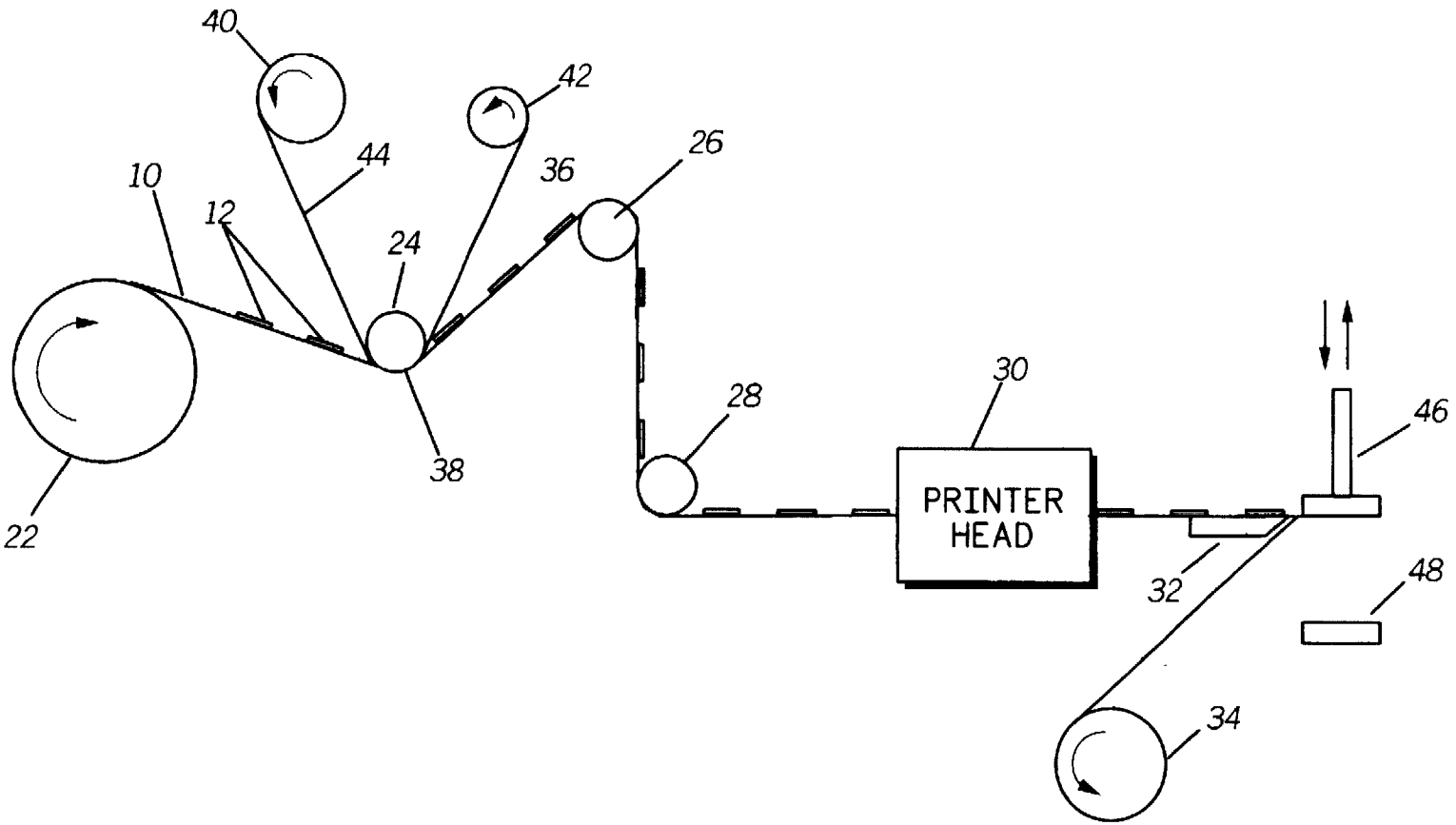
FIG. 3 is a diagram of a labeling apparatus in accordance with a second embodiment of the invention.

Referring now to FIG. 3, there is illustrated therein a diagram of a labeling apparatus 20 in accordance with a second embodiment of the invention. This apparatus is similar to that shown in FIG. 2, however the guide 24 is not necessarily a roller. Instead, a first tape reel 40 and a second tape reel 42 are provided, with a low tack tape 44 routed from the first tape reel, over the guide 24, and to the second tape reel. This tape has an adhesive side which acts as an adherent surface 36, and is disposed between the guide surface and the print surface of the labels as they move past the guide. The first and second tape reels are turned such that the tape 44 moves in correspondence with the labels as they move through the contact area 38. The result is the same as the first embodiment; the adherent surface is effectively rolled across the printing surface of each label to remove dust. The guide in this embodiment may simply be, for example, a smooth arcuate surface with a guide flange, as is common in the art, or it may be a conventional roller.

Once the labels have been cleaned and printed, they are dispensed to a label applicator head 46. The applicator head receives the label after it is separated from the carrier strip by the peeler plate, as is common in the art. The applicator head is provided is openings to vacuum hold the label, and is movable between a first position and a second position. It receives the labels in the first position, and moves to the second position where the label is applied to an article to be labeled 48. In practice, the labels could be applied to the article prior to printing, and could even be cleaned after being applied, then printed, all while on the article 48. This variation of the basic process would require somewhat more sophisticated control systems, but accomplishes the same result.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An apparatus for cleaning labels having print surfaces, said apparatus comprising:

a guide having a guide surface;

first and second tape reels;

a tape running from said first tape reel, over said guide, to said second tape reel, said tape having an a low-tack adherent surface; and means for moving said labels past said guide so that said adherent surface contacts said print surfaces of said labels;

wherein said second tape reel is rotated at a rate such that said adherent surface moves in correspondence with said labels and the adherent surface is effectively rolled across the print surface of the labels to provide contact with said print surfaces by unused portions of said adherent surface.

2. An apparatus as defined by claim 1, wherein said guide is a roller.

3. A method of preparing labels for dispensing, said labels pisposed on a carrier strip and having print surfaces, said method comprising the steps of:

routing said carrier strip from a feed reel, over a guide, a first idler roller, through a printer, over a peeler plate, and to a pick-up reel, and wherein said guide deflects said carrier strip such that a contact area is defined between said labels and a guide surface;

providing first and second tape reels; and routing a tape having a low-tack adherent surface from said first tape reel, over said guide, to said second tape reel, wherein said second tape reel is rotated at a rate such that said adherent surface moves in correspondence with said labels and the adherent surface is effectively rolled across the print surface of the labels to provide contact with said print surfaces by unused portions of said adherent surface.

4. A method of preparing labels as defined by claim 3, further comprising the step of printing information on said print surfaces.

5. A method of preparing labels as defined by claim 3, further comprising the steps of:

peeling said label from said carrier strip;

feeding said label to a label applicator; and applying said label to an article to be labeled.

* * * * *